US005224047A

United States Patent [19]

Kitagawa et al.

[11] Patent Number: 5,224,047

[45] Date of Patent: Jun. 29, 1993

[54] MAINTENANCE MONITORING APPARATUS FOR AUTOMATIC WINDER

[75] Inventors: Ikuo Kitagawa, Uji; Hidenao Miyaji, Kyoto, both of Japan

[73] Assignee: Murata Kikai Kahushiki Kaisha, Kyoto, Japan

[21] Appl. No.: 591,074

[22] Filed: Oct. 1, 1990

[30] Foreign Application Priority Data

Oct. 3, 1989 [JP] Japan ..... 1-256967
Feb. 21, 1990 [JP] Japan ..... 2-15638[U]

[51] Int. Cl.[5] ..... G06F 15/46; D01H 13/26

[52] U.S. Cl. ..... 364/470; 364/138; 57/264

[58] Field of Search ..... 364/131, 132, 138, 470; 340/825.06; 242/35.5 R; 57/264, 265

[56] References Cited

U.S. PATENT DOCUMENTS

| | | | |
|---|---|---|---|
| 4,194,349 | 3/1980 | Lane | 57/265 |
| 4,408,447 | 10/1983 | Sloupensky et al. | 364/470 |
| 4,846,618 | 7/1989 | Matsui | 242/35.5 A |
| 4,880,175 | 11/1989 | Yamauchi et al. | 242/35.5 R |
| 4,899,286 | 2/1990 | Colli et al. | 364/470 |
| 5,046,013 | 9/1991 | Ueda et al. | 364/470 |

*Primary Examiner*—Jerry Smith
*Assistant Examiner*—Paul Gordon
*Attorney, Agent, or Firm*—Spensley Horn Jubas & Lubitz

[57] ABSTRACT

A maintenance monitoring apparatus comprised of an information processing machine for making a maintenance working plan for an automatic winder in response to an input data, outputting it and at the same time displaying the state of progress and a portable operating unit for inputting in sequence to the information processing machine the content of work applied by the operator to the automatic winder in accordance with the aforesaid work plan.

7 Claims, 5 Drawing Sheets

FIG. 7

12

MAINTENANCE WORK DATE : _____

| WINDER NO. | PACKAGE NO. | ITEMS | CONTENT OF WORK | FINISHED/ NOT-FINISHED | REMEDY FOR ABNORMAL STATE |
|---|---|---|---|---|---|
| NO. 12 : | _____ | : BLOWER BRG | FEEDING GREASE | ☐ | _____ |
| | _____ | : CAM SHAFT BRG | FEEDING GREASE | ☐ | _____ |
| NO. 8 : | _____ | : TRAY CONVEYOR | INSPECTION | ☐ | _____ |
| NO. 15 : | 1 TO 48 PACKAGES | : TENSION CUTTER | FEEDING OIL | ☐ | _____ |
| | | : DRUM BRAKE | INSPECTION | ☐ | _____ |
| ・・・・ | ・・・・ | ・・・・ | ・・・・ | ・・・・ | ・・・・ |

MAINTENANCE MONITORING APPARATUS FOR AUTOMATIC WINDER

FIELD OF THE INVENTION

The present invention relates to a data collecting device for winders and relates to a maintenance monitoring device for the winders.

RELATED ART STATEMENT

In general, an automatic winder is constructed such that a plurality of winding units are arranged in a side-by-side relation to form one winder and a plurality of winders from No. 1 to No. n winders are arranged in parallel in a spinning plant. In case that each of the winding units detects a fault such as sub in a running yarn, the yarn is forcedly cut, an upper yarn of a package is connected to a lower yarn of a yarn feeding bobbin to eliminate the yarn fault. Also, in case that a tension cutting other than the slub and no yarn at the yarn feeding bobbin, a similar yarn connecting operation is carried out. If the yarn connection is well done, a normal yarn winding is carried out again and even after the yarn connections of the predetermined number of times, no yarn connection is made, a yellow button (indicating that the yarn connection may not be performed) is projected from the unit, its winding operation is stopped and the incapability of the yarn connection is informed to the operator or the working vehicle.

The automatic winder is provided with a concentrated controller device for each of the winder units for each of the winder units, i.e. a specified length measuring device capable of collecting various data such as the yarn winding length for the package in each of the winding units and the erroneous rewinding times for the wrong connected yarns and then an understanding of the operating condition in each of the winding units and a total setting of various set values or the like can be carried out. In addition, a top part of the length measuring devices in each of the winder units is provided with an abnormal alarm lamp.

However, several winding units are arranged in a side-by-side relation for each of the automatic winders No. 1 to No. n, and one concentrated controller device is mounted at one end of each of the winders. Due to this fact, in case that it is desired to get some history data such as rewinding times of wrong yarn connection for one winding unit having a questionable operation for its normal act, an operator must go to the place where the concentrated controller device to which the corresponding winder unit belongs every time the corresponding winder unit is different.

In addition, the concentrated controller device does not understand a visual inspecting information through the operator, e.g. the information concerning a presence or non-presence of the fall of pattern of the package collected, so that the operator may not get such information at the concentrated controller device. Accordingly, in case that a certain one winder unit is checked for its poor bobbin or in case that the poor winding unit is to be repaired or maintained, a sufficient requisite data could not be attained.

OBJECT AND SUMMARY OF THE INVENTION

In view of the aforesaid problems, the present invention has been invented and it is an object of the present invention to provide a data collecting device capable of collecting data which is effective for judging a well or bad state of the winder unit immediately in reference to its working position.

It is another object of the present invention to provide a new maintenance monitoring apparatus for an automatic winder capable of performing an appropriate maintenance work and getting a fast understanding of the state of maintenance work.

The data collecting device of the present invention is constructed in a plant where several winder units are arranged in side-by-side relation, a plurality of winder devices of which one winder is composed with a concentrated controller device for the winder units arranged at one end thereof, wherein the concentrated controller device for each of the winder devices is connected to one central controller device composed of a computer, the aforesaid central controller device is connected to a remote controller carried by an operator in a wireless form, and various data of each of the winder units can be inputted from the remote controller to the central controller device.

Each of the concentrated controllers arranged for each of the winders is connected to one central controller device and this central controller device is connected to the remote controller carried by the operator. Due to this fact, the operator may execute an inspection such as a visual inspection of the required package in response to an instruction from the central controller device, various data for each of the winder units including a result of inspection are sent directly from the working position to the central controller device and then the data can be collected, resulting in that a quite efficient data collection can be performed.

The present device is further comprised of an information processing machine for making a maintenance working plan for an automatic winder in response to an input data, outputting it and at the same time displaying the state of progress and a portable operating unit for inputting in sequence to the information processing machine the content of work applied by the operator to be automatic winder in accordance with the aforesaid work plan.

With the aforesaid arrangement, the worker may perform the maintenance work for the automatic winders in compliance with the maintenance work plan made by the information processing machine and may input information such as a finished work and a presence or non-presence of abnormal state or the like to the information processing machine by using the portable operating unit for every items. The maintenance supervisor may understand the state of progress of the maintenance in reference to this report to perform an appropriate processing and at the same time add the data of result of maintenance work to the information processing machine to cause it to draft a subsequent maintenance work plan.

BRIEF DESCRIPTION OF THE DRAWINGS

FIG. 7 is a front elevational view for showing a content of display of the displaying unit shown in FIG. 2.

DETAILED DESCRIPTION OF PREFERRED EMBODIMENT

Referring now to the preferred embodiment of the present invention will be described as follows.

Figure 1:
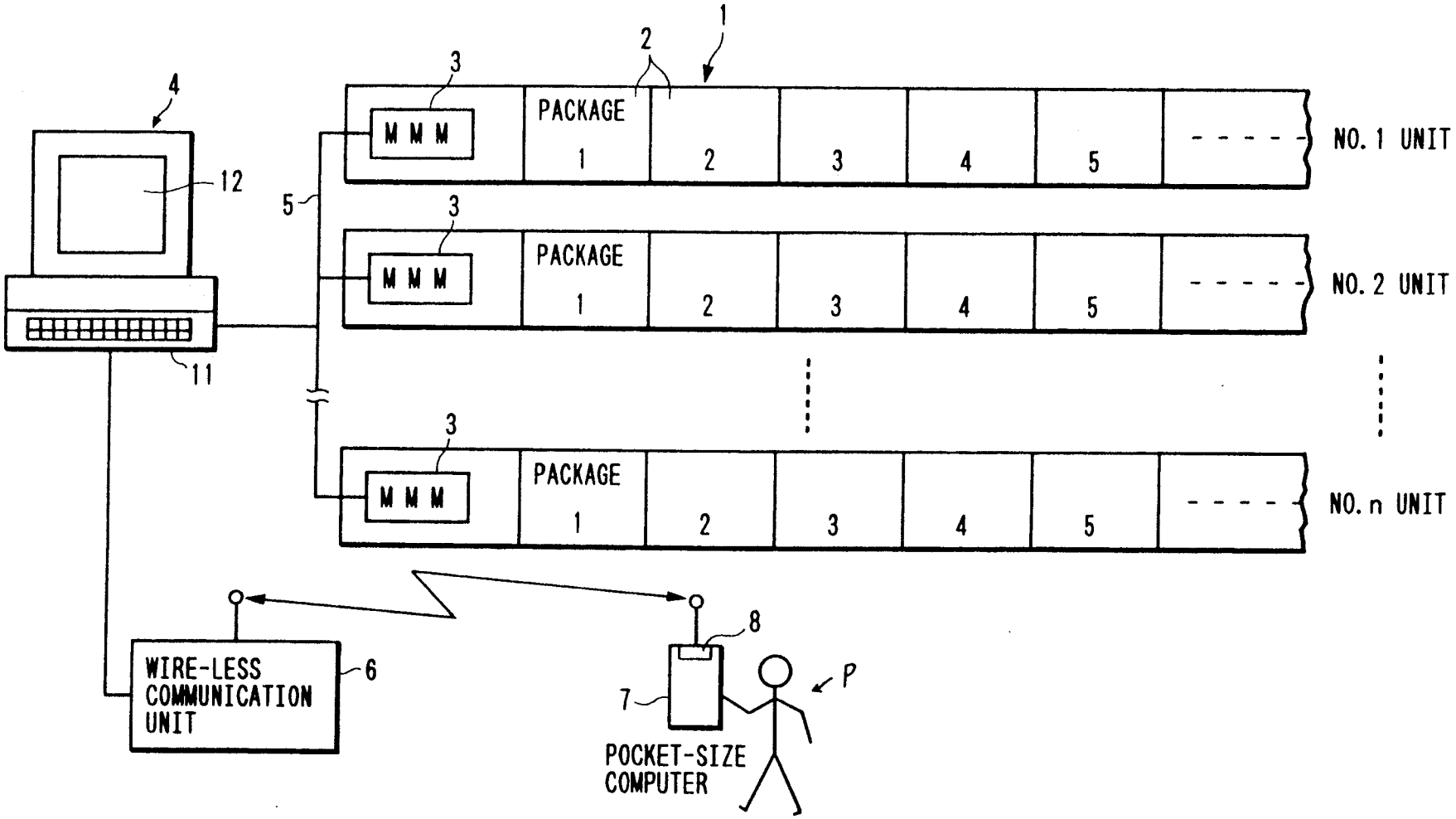
FIG. 1 is a schematic view for showing a data collector of a winder of one preferred embodiment of the present invention.

In FIG. 1, 1 denotes an automatic winder in which a plurality of winder units 2 are arranged in side-side-by relation to form one winder device. The winder devices from No. 1 to No. n are arranged in parallel to each other. One end of each of the winder devices is provided with the concentrated controller devices 3 for each of the winder units 2, respectively. The concentrated controller devices 3 for each of the winders are of specified length devices in this preferred embodiment, and various data such as winding length of the yarn to the package and rewinding of the erroneous yarn connection for every unit, understanding of the operation condition and various set values can be totally set. This specified length device, i.e. the concentrated controller device 3 has a testing operation control function capable of manually controlling an inching operation of each of the winder units 2, in particular.

4 denotes a central controller device for totally monitoring the information supervised by the concentrated controller devices for the winder No. 1 to the winder No. n and this controller device is composed of a host computer. This central controller device 4 is connected to each of the concentrated controller devices 3 for the winder No. 1 to the winder No. n with a transmittance line 5 so as to enable the data to be received and transmitted. To the central controller device 4 is connected a wire-less communication device 6 composed of a wire-less transmitter and receiver based on RS232C or the like, for example. 7 denotes a remote controller composed of a pocket-sized computer or a-handy type computer having a wire-less communication device 8 based on RS232C. The remote controller 7 is carried by each of the number of (m) of operators and each of the wire-less communication devices 8 can be communicated with the wire-less communication device of the central control device 4 in wire-less manner.

Figure 2:
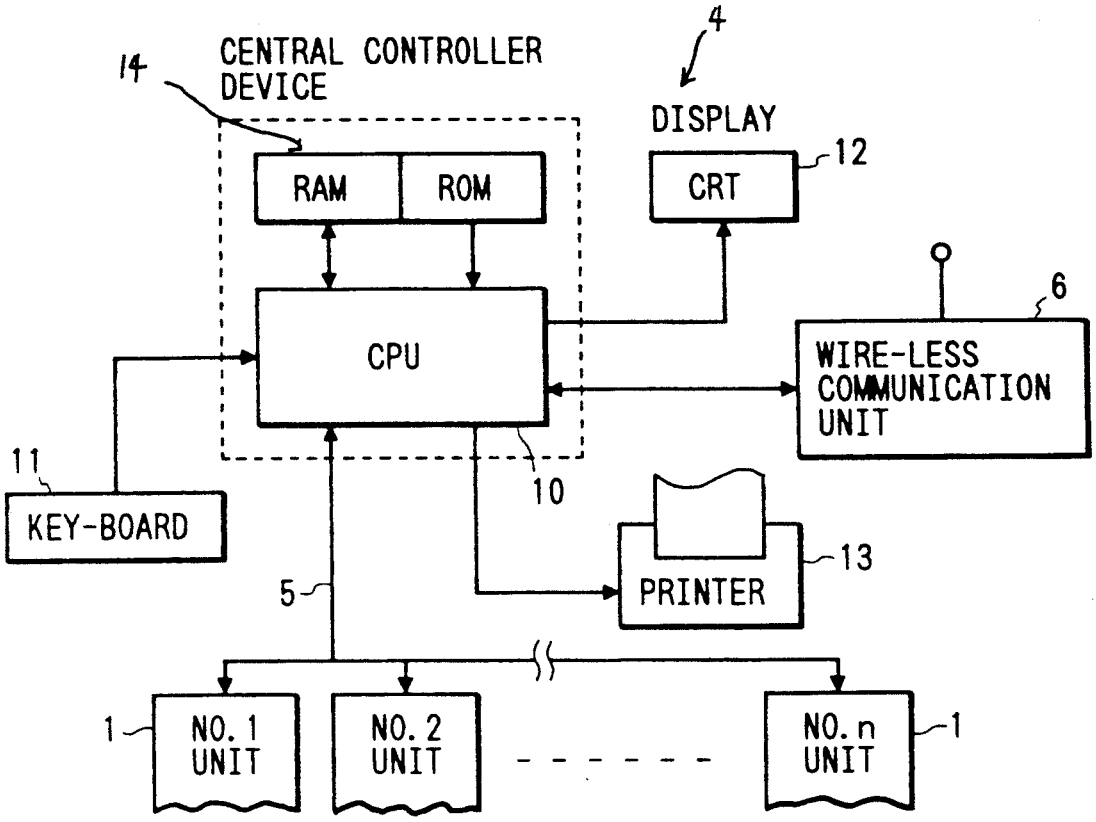
FIG. 2 is a configuration view for showing a concentrated controller device at the winder device.

FIG. 2 illustrates a configuration of the concentrated controller device 4 at the winder devices and this controller device is mainly composed of a host computer 10 including RAMs and ROMs and further the controller device is provided with a key-board 11, a CRT display 12 and a printer 13. The central controller device 4 is connected to each of the concentrated controller devices 3 for the winder devices No. 1 to No. n through a transmittance line 5 and then the controlling and data collection are carried out through a serial communication and by parallel signals. ROM has this program and another program for performing an inching operation for each of the aforesaid winder units 2. The aforesaid wire-less communication device 6 is connected to the computer 10 through RS232C port not shown.

Figure 3:
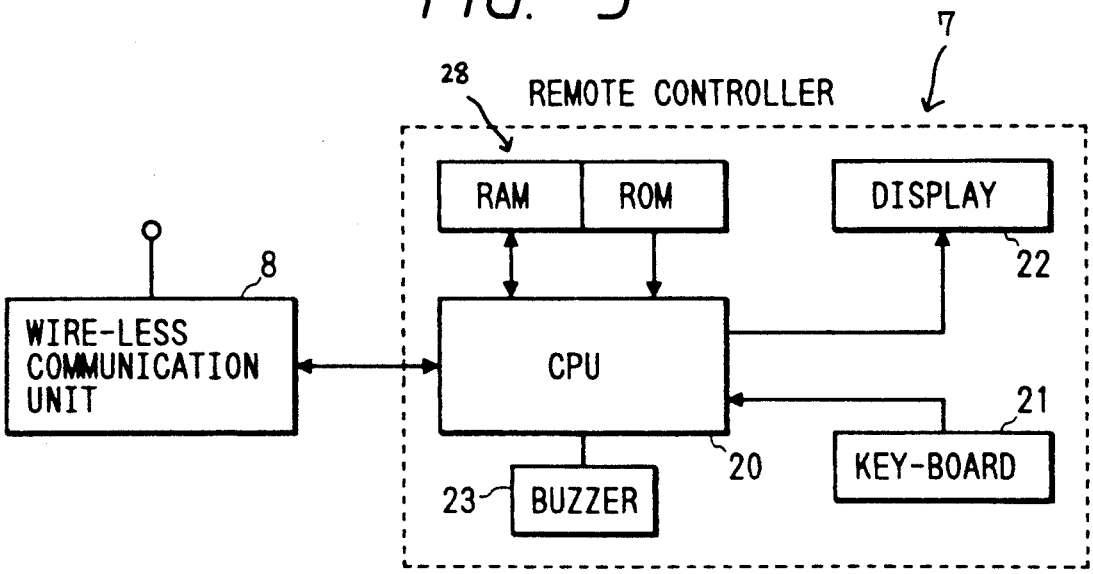
FIG. 3 is a configuration view for showing a remote controller carried by an operator.

FIG. 3 illustrates a configuration of the remote controller 7 which is mainly composed of a microcomputer 20 including RAMs and ROMs and this is provided with a key-board 21, a display unit 22 and a calling buzzer 23. An inching operation instruction for each of the winder units 2 is given through this key-board 21. The aforesaid wire-less communication unit 8 is connected through RS232C port.

Operation of the device will be described.

Figure 4:
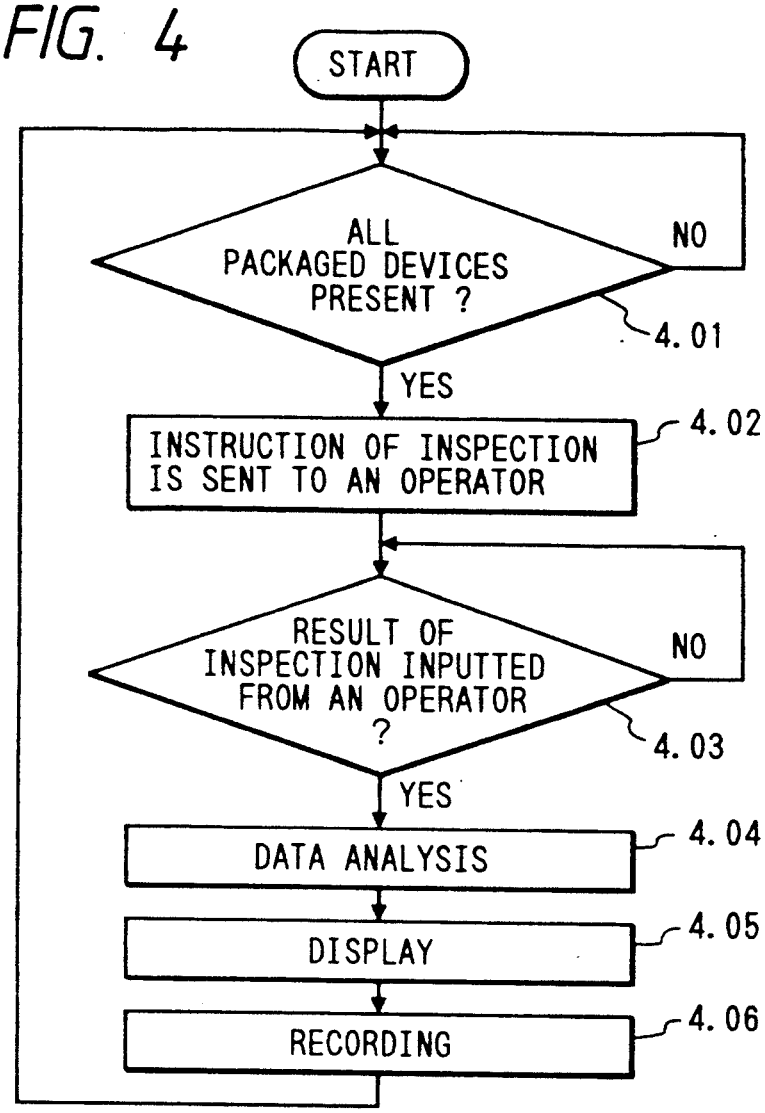
FIG. 4 is a control flow diagram for a concentrated controller at the winder device.
Figure 5:
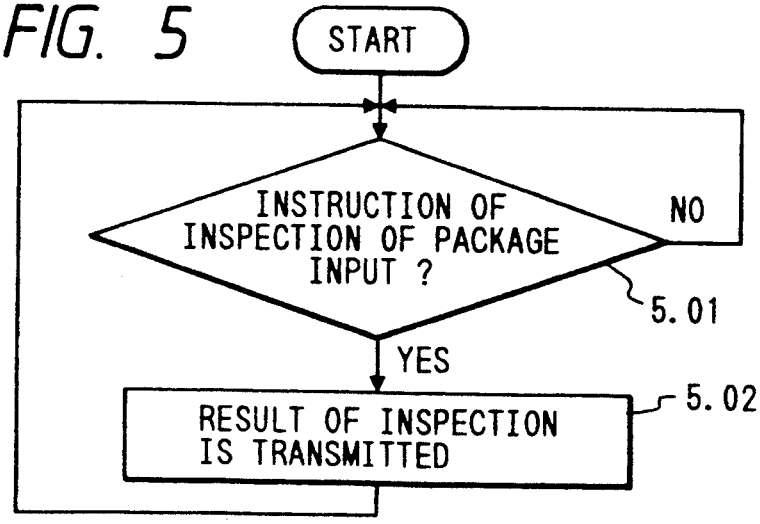
FIG. 5 is a control flow chart for the remote controller carried by an operator.
Figure 6:
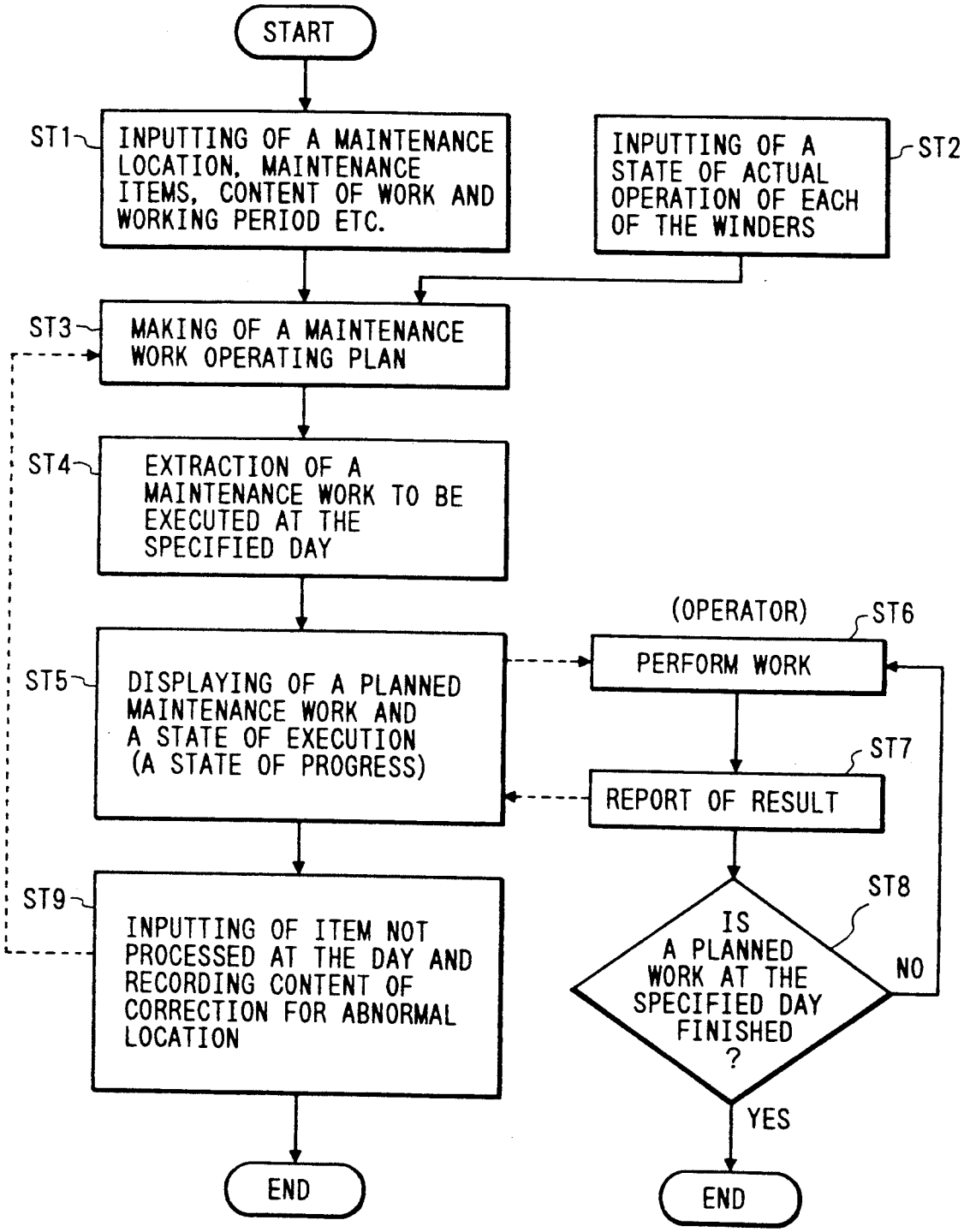
FIG. 6 is a flow chart for illustrating an action of the device shown maintenance monitoring operation.

FIG. 4 illustrates a controlling flow of the central controller device 4 for the winder devices and FIG. 5 illustrates a control flow of the remote controller device 7.

① Informing of Package Inspection Instruction

In FIG. 4, the computer 10 for the central controller device 4 may receive various information coming from each of the concentrated controller devices 3 so as to monitor a packaged condition of each of the winder units 2 for No. 1 to No. n. If there is a winder device completed the packaging operation (4.01), the number of the winder as well as the package inspection instruction are informed to the remote controller 7 carried by the operator through a wire-less communication between the wire-less communication device 6 and the wire-less communication device 8 (4.02), and then the computer may wait until "a result of inspection" concerning the package is sent from the remote controller 7. (4.02 to 4.03). In this case, a discrimination of the communication partner from the central controller device 4, i.e. each of the remote controllers 7 for the number of (m) of the operators is not performed in particular.

② Data Input of Package Inspection Result

In FIG. 5, the micro-computers 20 of all the remote controllers 7 may ring a calling buzzer 23 in case that the package inspection instructions from the winders are received, and display in the displaying unit 22 the number of winder packaged and that the package is to be inspected.

Then, the operator may visually inspect the packages of all the packaged winders whether there are some faults such as a fall of pattern or the like.

In case that there are some falls of patterns or the like, the key-board is operated and poor data such as the type of faults as well as their degree or the like are inputted together with a spindle No. and its corresponding winder No. of the winder unit having the faults. That is, the result of inspection (No. of the winder, No. of package and a presence or absence of fall of pattern or the like) is inputted in sequence on site. With this arrangement, the result of inspection of the package is communicated from the wire-less communicator 8 to the wire-less communicator 6 in a wire-less form and then inputted to the host computer 10 of the central controller device 4. Accordingly, the poor data of the winder unit is separately collected at the central controller device 4. Confirmination of the collected data of what No. of the winder in what No. of the winder device is applied is carried out by adding the No. of the winder device and No. of spindle in the transmittance frame from the operator.

③ Analysis of Collected Data

As the "result of inspection" is sent from the operator, the central controller device 4 at the winder device in FIG. 4 (4.03) may analyze the input data independently or together with the accumulated data up to now (4.01), diagnose the winder unit of what No. of the device and what package is poor and display the result of diagnosis in the CRT display 12 (4.05) and at the same the result is recorded in a hard disk or a floppy disk or the recorded in a recording sheet through a printer 13 (4.06).

The aforesaid processing is repeated every time for all the packaged winder devices.

In this way, the operator may judge it any time at only one central controller device 4 whether one winder unit is a poor package of not or get data required for performing a maintenance work for the poor winder unit. In particular, a visual inspection data of the operator not processed by the concentrated controller device is also contained in this data and so a searching of the cause of the poor package may easily be carried out. Since it is also possible to understand that the same poor state appears in several times in response to the stored or recorded data of history and it can be rapidly judged that the poor winder device is present or the cause of poor winder exists.

An automatic informing operation under an occurrence of the abnormal state at the winder device, getting of various data from the remote controllers 7, the understanding of the operating condition or the controlling operation at the winder device will be described as follows.

(1) An automatic informing in case of an abnormal occurrence at the winder device In case that there occurrence some abnormal states in each of the winder units, a yarn end finding device not shown and a packaging device show some abnormal states, the central controller device 4 may inform it to the remote controller 7 in wire-less form, ring a calling buzzer 23 and display the abnormal state in the displaying unit 22.

(2) Getting various data and understanding an operating state

If an operator wants to collect various data and understand an operating state, he operates the keyboard 21 and instructs it (to display data). The central controller device 4 at the winder device may transmit the accumulated data up to now and the remote controller 7 may display the received data in the displaying unit 22.

(3) Control at the winder device

A controlling operation for the winder device is carried out in case that various set values of the winder units at the winder devices are totally set or various testing operations for the winder unit are to be controlled. In this case, a manual inching operation for the yarn joining operation will be described.

In case that it is desired to control the aforesaid winder device. the operator may operate the key-board 21 and instruct it (to perform a controlling operation) to the partners No. of the winder device to be controlled and a spindle No. of the winder unit. The remote controller 7 may transmit a message of "starting control" and if the message of "a completed preparation" is sent, it may transmit the controlling content or the set value. Upon receiving the controlling content or the set value, the central controller device 4 at the winder device may give an instruction of execution of the content to the concentrated controller device 3 and causes the specified winder unit to perform a predetermined operation.

That is, set values for each of the spindles in the winder units are totally set or the control for the yarn joining operation is carried out for the specified winder unit having the specified spindle No. In particular, the controlling of the latter yarn joining test is carried out in such a way as the yarn joining device of the winder unit 2 is operated in inching in response to a program stored in ROM of the central controller device 4. With this arrangement, since the yarn joining operation which is hardly acknowledged visually due to its instantaneous operation may be realized while visually looking at the winder unit and while performing the inching operating by the operator, it is possible for the operator to perform a careful testing operation. In the aforesaid one operation, only a part of the entire yarn joining operation may be carried out, an inching operation of next stage can be performed to repeat the aforesaid processing.

Upon completion of the aforesaid desired operation, a message of "a normal control operation is completed" is transmitted from the central controller device 4, resulting in that the remote controller at the operator may finish its processing.

With this arrangement above, various self testings, controlling of the winder devices, controlling of the winder unit and changing of various set values or the like can be performed, and the getting of desired data may also be performed quite easily. In particular, in case of the testing operation, the operator may go to the specified winder unit with his remote controller, instruct there in wire-less manner and perform the testing operation while looking at the winder unit.

As described above, according to the present invention, one central controller device for monitoring each of the concentrated controllers for a plurality of winder devices is connected to the remote controller carried by the operator in a wire-less manner, so that the operator may execute the inspection such as a required visual inspection of package or the like and directly transmit the data of the result of inspection from the working location to the central controller device and thus a quite efficient data collection can be carried out.

Next, a maintenance monitoring device for an automatic winder to which above mentioned data collecting device is applied.

The automatic winder is provided with a concentrated controller device for every winder device where an understanding or the operating conditions at each of the winder units or a total control over various set values is carried out.

In order to keep the production line in good state, some driving locations are regularly inspected and the operator or worker may inspect or feed oil for a bobbin transferring system for each of the winder devices or a taking-up mechanism of each of the winding units in reference to a predetermined check list or the like.

However, it has been quite difficult to perform a proper maintenance work. That is, there are a large number of automatic winders and further a quite large number of bobbins of the winder units as well as various types of inspection items, and thus it is quite difficult to perform the maintenance work strictly in accordance with the appropriate inspection period for each of the specific winder units. Due to this fact, in the prior art automatic winders, there has been a problem that a trouble caused by a delay in the maintenance work occurs.

In the prior art, there has been a problem that a long period of time is required for a maintenance supervisor at the plant to understand the maintenance state due to the fact the each of the workers describes the maintenance work in a working report list to inform the result of maintenance at that day and further that a starting to get a subsequent countermeasure such as an appropriate processing for abnormal states of an entire line or each of the winder devices or a study of understanding the cause of trouble is delayed.

The present device is comprised of an information processing machine for making a maintenance working plan for an automatic winder in response to an input data, outputting it and at the same time displaying the state of progress and a portable operating unit for inputting in sequence to the information processing machine the content of work applied by the operator to he automatic winder in accordance with the aforesaid work plan.

As shown in FIG. 2, the information processing machine 4 has a calculation processing device (CPU) 10 connected to the external storage devices (RAM, ROM) 14 so as to enable a work plan to be established and at the same time the maintenance work to be executed at the specified day. As an outputting part, a printer 13 for outputting the content displayed is provided in addition to the displaying unit 12. The external storage device 14 stores the programs required for making a plan and calculation and further as shown in Table 1, the items relating to the regular maintenance work for the automatic winders 2, e.g. the inspection items and the frequency of inspection (a period) instructed in the operating manual are inputted.

TABLE 1

| Frequency | Item | Working Content |
|---|---|---|
| Weekly | Drum, Brush & Tray Conveyor | Inspection, removal of waste yarn Check of running state |
| Monthly | Yarn joining port | Measurement of strength of the connected yarns |
| | Tention cutter | Check of cutting |
| Half a year | Drum brake | Confirmation of operation |
| | Line shaft BRG | Inspection |
| | Blower BRG | Inspection |

The calculation processing device 10 may display it in the displaying unit 12 how the planned work is executed in response to the information received from the portable operating unit 7 via wire-less communication units 7 and 8.

As shown in FIG. 3, the portable operating unit 7 is a handy type computer mainly having the external storage devices (RAM, ROM) 28 and the calculation processing device (CPU) 20, and this is provided with a key-board 27 for the operator to key-in the working report and the displaying unit (CRT) 22 for confirming visually the content of the keying-in content. That is, it may transmit the content so as to cause the progress of operation to the inputted to the information processing machine 4 (external storage device RAM 14). The entire portable operating machine 7 is compact in size and light in weight and the operator P may easily carry it in hand.

Operation of the preferred embodiment of the present device will be described as follows.

As shown in FIG. 4, at first the content of regular inspection of the automatic winder 1 shown in Table 1 (the maintenance location, maintenance items, contents of maintenance work and a frequency of operation or the like) are inputted (ST 1). In simultaneous with this operation, the date of starting of the automatic winder 1 and a period of interruption of the operation or the like are inputted (ST 2).

Through this inputting operation, the calculation processing device 10 of the information processing machine 4 may make the most suitable maintenance work executing plan (ST 3). As the maintenance supervisor inputs the date of performing the work through the key-board 11, the maintenance work to be executed at the specified day is extracted from the work plan (ST 4) and then it displays the maintenance location to the displaying unit 12 (ST 5).

As shown in FIG. 7, this displaying is performed such that the items and the content of work are clearly indicated for every winder devices and their winding units (a spindle No.). In case of feeding oil to perform the maintenance work, the kind of the applied oil and the amount of oil fed. The screen of the displaying unit is provided with an additional space for displaying the processed content when there is a certain abnormal state as well as whether the work is completed or not (a discrimination of completion or not-yet-completed).

Then, the operator P may perform the work in sequence in response to this displayed state (ST 60 and the operator may input the information as the result on the work through the key-board 16 of the portable operating unit 7 (ST 7). At this time, the working items and the result of work at the specified day can be coded and simply inputted. The inputted content is instantaneously indicated in the displaying unit 6 of the information processing machine 4 and then the maintenance supervisor may understand the state of progress at sight. These maintenance work and the work reporting operation are continued until the planned work at the specified day is completed (ST 8).

As the working termination time at the specified day reaches, the maintenance supervisor may record the displayed items in the information processing machine 4 as the record of the maintenance work of the specified day. At this time, the item which could not be processed due to a certain cause at the specified day is inputted and the maintenance work plan subsequent to the next day is corrected and at the same time the content of correction for the abnormal location to be specified is also recorded. (ST 9)

In this way, since there are provided the information processing machine 4 for making the maintenance work plan and for displaying the state of progress of the plan and the portable operating unit 7 for inputting the content of work performed by the operator P in accordance with the work plan to the information processing machine 4 in sequence, the regular inspection for the automatic winder 1 and the winding unit can be performed at a proper inspection period specific to each of the items. That is, an appropriate performing of the maintenance work enables the trouble caused by the delay in maintenance work to be prevented and at the same time the winder devices can be operated always under the superior condition.

In addition, the report of work is inputted on real time to the information processing machine 4, resulting in that the maintenance supervisor can understand the state of maintenance positively and fast, then a proper remedy for the abnormal state or a countermeasure against the study of the trouble can be smoothly carried out.

In addition, the operator P may eliminate an inspection while referring the check list or a describing of the result in the work report sheet and then a burden of the work can be reduced and at the same time it is possible to eliminate the useless number of workers for the maintenance work and to apply a minimum number of workers. In addition, it can be contributed to the paper-less working in the plant.

In the preferred embodiment of the present device, the information processing machine 4 is communicated with the portable operating unit 7 in a wire-less manner, so that it is possible to bring the portable operating unit 7 to a narrow location and then a parallel operation of this work together with the inspection work enables a forgetting of report to be prevented in advance.

The planned work at the specified day (FIG. 7) is printed out in the printer 13 as well as a displaying in the displaying unit 12 of the information processing machine 4 and each of the operators P may keep the printed-out report. The result may be transmitted to the portable operating unit 4 and may be displayed in the displaying unit 22. In this way, a burden of the operator P is further reduced.

In brief, the present device may have the following superior effects.

The present device is provided with an information processing machine for making the maintenance working plan in reference to the inputted data and displaying the state of progress of the work and a portable operating unit for inputting the content of work applied to the automatic winders to the information processing machine, so that the maintenance work can be properly performed and at the same time, the maintenance supervisor may understand the state of maintenance positively and fast and thus it is possible to perform a smooth operation of a countermeasure after inspection or the study of the causes of the troubled state.

What is claimed is:

1. A data collection device for use with a plurality of winders, the winders including a plurality of winding units and a concentrated controller, the device comprising:

central control means, operably connected to the concentrated controllers, for receiving, storing and transmitting data, the data including winding data from the winders, and remote control means, detected from, and in wireless communication with, the central control means, for receiving data from the central control means and for transmitting data obtained by visual inspection to the central control means, wherein the central control means is adapted to store the data obtained by visual inspection transmitted by the remote control means.

2. The data collection device of claim 1, wherein the winding data received by the central control means includes data relating to at least one of an amount of yarn wound to a package, a yarn fault and a failure to properly connect yarn ends.

3. The data collection device of claim 1, wherein the remote control means includes input means for inputting data and instructions, and display means for displaying data received from the central control means.

4. The data collection device of claim 3, wherein at least one of the concentrated controllers includes inching means for controlling an inching operation on a winder and wherein the inching operation may be initiated by the input means of the remote control means.

5. A method for monitoring a plurality of winders, the winders including a plurality of winding units and a concentrated controller, the method comprising the steps of:

providing central control means, operably connected to the concentrated controllers, for receiving winding data from the winders, providing remote control means, in wireless communication with the central control means, for transmitting data to, and receiving data from, the central control means, receiving winding data from at least one concentrated controller, visually inspecting at least one of the winding units, and transmitting a result of the visual inspection to the central control means with the remote control means.

6. The method of claim 5, wherein the remote control means includes display means for displaying data, the method further comprising the steps of:

transmitting inspection instructions from the central control means to the remote control means, and displaying the inspection instructions on the display means.

7. The method of claim 5, further comprising the steps of:

analyzing the winding data received from the at least one concentrated controller with the central control means, and analyzing the result of the visual inspection with the central control means.

* * * * *